US009586211B2

(12) United States Patent
Marsh

(10) Patent No.: US 9,586,211 B2
(45) Date of Patent: Mar. 7, 2017

(54) KREEGER SLUICE

(71) Applicant: John Anthony Marsh, Watsonville, CA (US)

(72) Inventor: John Anthony Marsh, Watsonville, CA (US)

(73) Assignee: John Anthony Marsh, Watsonville, CA (US)

( * ) Notice: Subject to any disclaimer, the term of this patent is extended or adjusted under 35 U.S.C. 154(b) by 0 days.

(21) Appl. No.: 14/582,178

(22) Filed: Dec. 23, 2014

(65) Prior Publication Data

US 2015/0182972 A1 Jul. 2, 2015

Related U.S. Application Data

(60) Provisional application No. 61/921,243, filed on Dec. 27, 2013.

(51) Int. Cl.

| | |
|---|---|
| ***B03B 5/00*** | (2006.01) |
| ***B03B 5/26*** | (2006.01) |
| ***B03B 5/02*** | (2006.01) |
| *B03B 4/06* | (2006.01) |
| *B03B 4/00* | (2006.01) |
| *B07B 13/11* | (2006.01) |

(52) U.S. Cl.
CPC ..... *B03B 5/26* (2013.01); *B03B 5/02* (2013.01); *B03B 4/00* (2013.01); *B03B 4/06* (2013.01); *B07B 13/113* (2013.01)

(58) Field of Classification Search
CPC .... B03B 5/02; B03B 5/06; B03B 5/26; B03B 4/00; B03B 4/06; B07B 13/113
USPC ..... 209/466, 471, 474, 477, 479, 484, 506, 209/507
See application file for complete search history.

(56) References Cited

U.S. PATENT DOCUMENTS

| | | | | |
|---|---|---|---|---|
| 2,294,587 A * | 9/1942 | Vissac | B03B 5/68 | 209/458 |
| 2,989,184 A * | 6/1961 | Gobatti | B03B 5/72 | 209/437 |
| 3,941,690 A * | 3/1976 | Powers | B03B 5/26 | 209/44 |
| 5,191,981 A * | 3/1993 | Young | B03C 1/23 | 209/223.1 |
| 9,114,403 B1 * | 8/2015 | de Lange | B03C 1/0332 | |

* cited by examiner

*Primary Examiner* — Joseph C Rodriguez
*Assistant Examiner* — Kalyanavenkateshware Kumar
(74) *Attorney, Agent, or Firm* — IP Clinic at Lincoln Law School

(57) ABSTRACT

A sluice box is described comprising two walls, and a plurality of riffles. Riffles can have a first portion that extends below the bottom panel of a sluice box (or the bottom of a flow), and a second portion that extends above the bottom panel of a sluice box (or the bottom of a flow). By creating a catch in a riffle by having a portion of the riffle extend below a bottom panel of a sluice box, heavier minerals are not washed away as quickly, if at all, as with other sluices.

20 Claims, 3 Drawing Sheets

KREEGER SLUICE

CROSS-REFERENCE TO RELATED APPLICATIONS

This application claims priority to U.S. Provisional Patent Application No. 61/921,243, filed on Dec. 27, 2013, entitled "The Kreeger Sluice." The aforementioned provisional patent application is hereby incorporated herein by reference in its entirety.

FIELD OF THE INVENTION

The present invention generally relates to the process and apparatus used in the separation and recovery of precious minerals and creation of super-concentrates of precious minerals from mineral bearing sands and gravel.

BACKGROUND

A wide variety of devices are employed to concentrate the gold present in certain rivers and streams of the world. The two most common devices currently in use are the sluice and the gold pan. The gold sluices of prior art produce concentrates that can be ninety-five percent or more waste minerals. These waste minerals are mostly black sand. The concentrates produced by prior art are difficult to separate into values and waste products. One problem is that a skilled panner must then reduce the concentrates to super-concentrates. This stage of concentration is labor intensive and requires skill. A separate device may be bought and employed to reduce the concentrates to super-concentrates much faster than panning by hand. At the super-concentrate stage the gold produced can be seen and the productivity of the prospect calculated. Prospectors often work with time constraints. Some must prove profitability to their investors.

A sluice is a water channel, typically controlled at its head by a gate, allowing water or other liquids to flow through. Sluice boxes (also referred to herein as "sluices" for the sake of brevity) are often used in the recovery of black sands, gold, and other minerals from placer deposits during placer mining operations. They can be small scale, as used in prospecting, or much larger, as in commercial operations, where the material can be screened first using a trammel or screening plant. Typical sluices have transverse riffles over a carpet which trap heavy materials, gemstones, and other valuable minerals. Various sluices have different types of riffles. Riffles are obstacles in a flow of water.

SUMMARY

Described herein are embodiments that disclose various types of sluices that can comprise various types of riffles. In various embodiments, a sluice can consist of 2 parallel side walls connected perpendicularly and forming a water tight seal to a bottom wall, with multiple high order riffles extending from wall to wall, which can be spaced uniformly between each other over the length of the sluice box. In various embodiments the riffles can be placed in the same direction as the water flow. Note that although water is used throughout this disclosure, it is contemplated that other liquids of various densities can be employed.

The problem with other sluices is their limited efficiency. The limitation is the use of turbulence which both disrupts laminar flow and impedes the flow reducing its velocity. Embodiments herein describe a device that can create a vortex of greater order and higher velocity without turbulence. Sluices described herein can surpass the efficiency barriers of prior devices that employ turbulence. The present disclosure employs a high order, laminar flow which passes over high order riffles that have a much greater efficiency than those of prior art. The sluices described herein not employ turbulence as part of the mineral separation process. The turbulence present in the invention is confined to specific locations (e.g., the turbulence reduction zone).

The efficiency associated with embodiments described herein eliminates the need for a separate device to reduce bulky black sand concentrates to super-concentrates. This is because embodiments of the invention described herein (also referred to as the new invention) collect only a very small amount of super-concentrates during use. Such embodiments solve the black sand problem by simply allowing the black sand to pass through the riffle during use. Embodiments of sluices described herein can be quickly cleaned out into a gold pan. The amount of super-concentrates produced is very small and easily assessed. Thus, the value of the precious mineral bearing sand and gravel worked by the embodiments of sluices described herein is known to a prospector immediately.

Laypersons can have problems understanding and effectively using older sluices in a river. The entire process is frought with hazards which threaten to reduce the efficiency of gold capture or even release gold that has been captured. Embodiments of the current invention reduce the problems of understanding and setting up a sluice for proper operation by generating a distinct water feature referred to herein as a "clear view lens," which will be described in more detail below.

Another problem associated with older sluices is booming. Booming is the overloading of sluices with black sand and gravel which is difficult and time consuming to correct. Sluices described herein can prevent booming by having a faster flow rate and inability to hold large amounts of material. Still, other problems with older sluices are caused by ripples and surges entering the sluice from the river flow. This occurs during use and especially when removing from a river for cleaning of a sluice. The ripples and surges become the dominant wave energy inside older sluices. They can travel freely through prior art as high and low pressure waves. These pressure waves can randomly erode captured materials from prior sluices. Ripples and surges can raise and lower the surface of the water repeatedly. This can allow concentrates gathered to be exposed to the surface tension present at the water's edge. The problem is that surface tension can cause gold to lift and float out of prior devices. Embodiments of the new invention described herein collect super-concentrates at the bottom of a catch. In various embodiments, a catch has been placed below the bottom of flow. By placing a catch at a bottom of a flow, the catch can keep its contents secure against ripples, surges, and surface tension. The super-concentrates collected using embodiments of a sluice described herein are kept under puddles when the slurry flow has stopped. The transition from flowing to puddling can be orderly in the new sluice. Previous sluices have a spill hazard when removing them from a river for cleaning Sluicing can be a delicate process performed on the rough terrain of a river. Embodiments described herein prevent spilling super-concentrates at most angles. In some embodiments, super-concentrates are kept in place against moderate shaking of the new sluice. Removing a sluice from a river is not a delicate process and embodiments described herein can prevent spilling.

Devices described herein, in effect, maximize a prospector's profit potential by eliminating the need for separate devices to reduce concentrates to super-concentrates, thus eliminating an un-necessary step in earlier processing approaches. Eliminating excess black-sands by allowing the black sand to erode from riffles described herein, results in a more concentrated super-concentrate over prior art and allows for a rapid assessment of the base material being processed. Sluices described herein can employ riffles, rubber mats, carpet filters, expanded or perforated grates, magnets, and or other components in many configurations.

Embodiments described in the present disclosure also reduce the knowledge needed for calibration by creating a new and distinct sluice feature. Various embodiments of this new feature can be referred to herein as a "clear view lens." In various embodiments, the clear view lens allows a user to view the sluice while water and materials are flowing through it. The presence of a clear view lens allows a user to confirm that high order functionality is being achieved. The clear view lens also provides for a novel direct visual observation of a riffle's efficiency and helps even the novice operator of the new invention to adjust the rate of which sand and gravel are fed into the new sluice based on the rate that the black sands are clearing. The volume of black sand present can vary between different materials but the proper rate of which to feed different materials into the new sluice is obvious to the layperson as the accumulation of gold or other minerals can be seen through the clear view lens. In some embodiments, a clear view lens can be a transparent material, while in other embodiments a clear view lens may simply refer to the ability to see through water or other liquid. Function and progress can be monitored in my new sluice through the clear view lens. Older sluices without the lens disclose a gold capture rate of eighty-five to ninety-five percent of more with expert use. The gold capture rate can drop dramatically with inexperience or any combination of hazards. Embodiments described herein have a gold capture rate consistently in the high ninety percentile.

Another novel feature disclosed herein is the shape of a collection area associated with riffles. In particular, various embodiments described herein can comprise a catch, that can be been located below (e.g., extend below) a bottom wall (or rubber mat, filter, etc.) of a sluice. For example, riffles described herein can descend below a plane corresponding with a bottom panel of a sluice and extend above the plane corresponding with the bottom panel of a sluice (note that a bottom panel can be replaced with a bottom flow, or other term used to describe the plane upon which riffles are typically located). While riffles commonly extend either above or below a bottom plane, in embodiments described herein a single riffle can extend both above and below a bottom plane (e.g., the bottom of a flow, the bottom panels of a sluice, etc.).

A catch in locations as described herein can secure valuable super-concentrates from ripples and surges, and can prevent their exposure to being washed away or being spilt during a move or cleaning. Various embodiments of riffles that are described herein further provide for increased erosion of waste product(s), such as black sands, thus allowing the direct recovery of precious minerals or the creation of super-concentrates of precious materials for further recovery.

Thus, embodiments described herein can be referred to as super-concentrate producing gold recovery sluices. Embodiments herein describe sluices that employ high order riffles and slurry flow to concentrate gold from sand and gravel containing gold. These sluices are suitable for river use or use with pumped water such as a high banker, super-concentrator, dredge, or wash plant, etc. Embodiments described herein can employ a new arrangement of stable, high velocity, vortexes. This arrangement can achieve great orderly force in a small space within the new riffles. Embodiments described herein are well balanced in many aspects and converges forces to aggressively erode black sand. The embodiments described herein virtually eliminate the black sand burden which saves prospectors time, money, and effort. The phenomenal rate of erosion is observed through a clear view lens. The appearance of a clear view lens in the slurry flow indicates full function of the riffles described herein. A clear view lens can allow for direct observation of the various riffles' functions. Turbulence created by riffles described herein appears in one place downstream from a riffle and is returned to high order flow before reaching the next riffle.

Further, embodiments described herein provide fast and accurate test results in the field. These test results can provide a new and powerful insight to determine which areas have the most precious minerals present. Samples can be tested in rapid succession because here the cleaning in between each test is not complicated. Some embodiments employ a one piece design that can be simple to construct from metals, plastics, rubber, ceramics, or combinations thereof Embodiments described herein have the speed of a sluice, the accuracy of a gold pan, and perform the duties of a super-concentrator. The invention can work even in a rugged river environment. The current invention has demonstrated the ability to remove not only precious metals but also lead, copper, brass, and mercury from sand and gravel.

DETAILED DESCRIPTION

Figure 1:
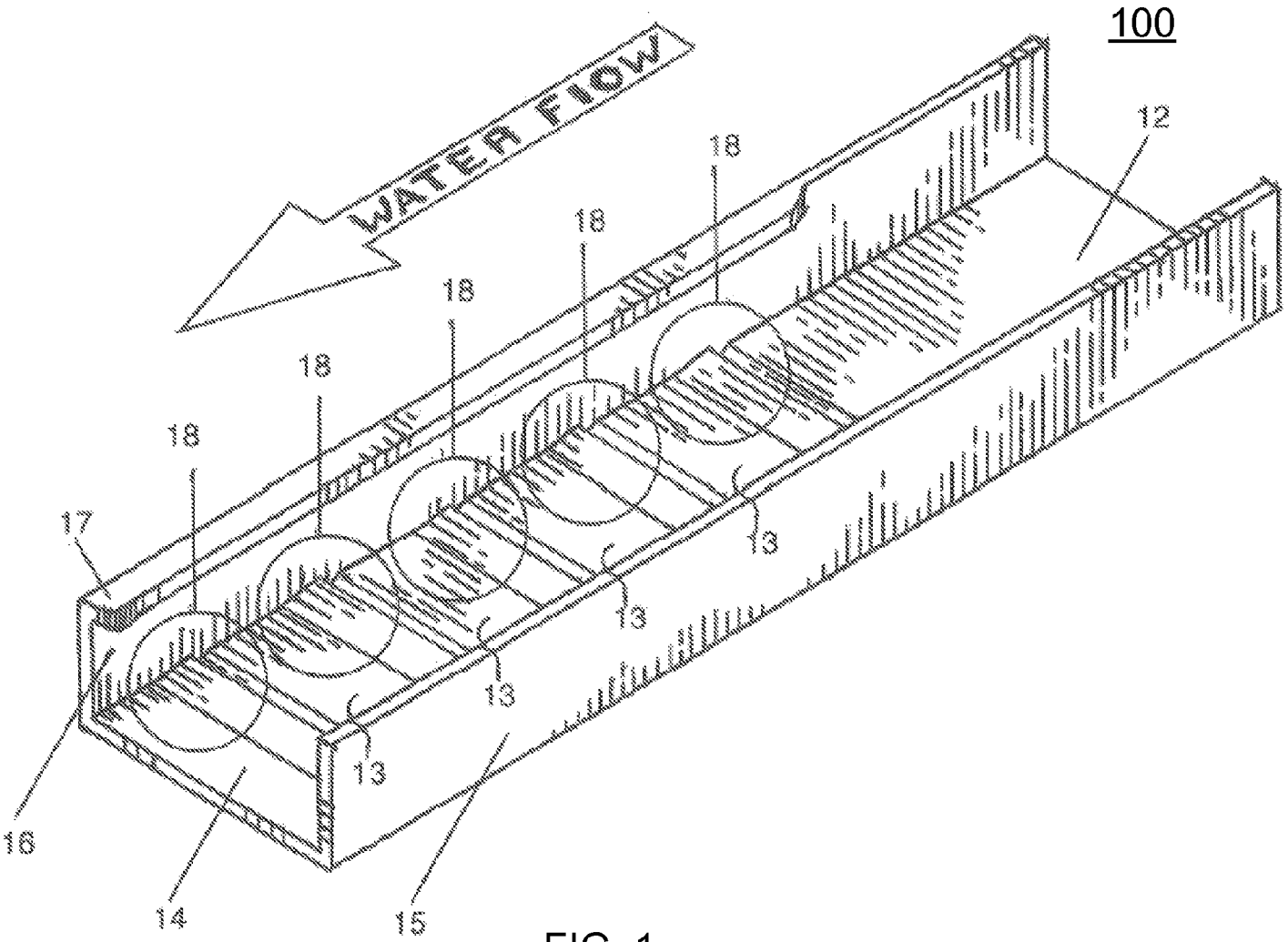
FIG. 1 illustrates a sluice, in accordance with various embodiments described herein.

As described above, various embodiments herein describe a super-concentrate producing gold recovery sluice. Sluices described herein sluice employ high order riffles and slurry flow to concentrate gold from sand and gravel containing gold. These sluices can be used in association with a river use or with pumped water such as a wash plant, dredge, or trommel. Various embodiments described herein employ an arrangement of vortexes that can achieve large amounts of force in a small space within the riffles. Embodiments described herein are well balanced in many aspects and converge various forces to aggressively erode black sand. As such, in some embodiments described herein, the sluice and corresponding riffles eliminate excess black sand, thus saving prospectors time, money, and effort.

In some embodiments, a rate of erosion can be observed through a clear view lens as described above. The clear view lens allows direct observation of a riffle's function. Turbulence created by one or more riffles appears in a first location and is returned to high order flow before reaching the next riffle. Various embodiments described herein provide fast and accurate test results in the field. These test results allow a user to determine locations that have the more precious minerals present than other locations. In some embodiments, samples can be tested in rapid succession because cleaning a sluice is not required in between each test. Gold can be seen accumulating under a clear view lens showing an operator a sluice's progress in collecting gold. It can take less than five minutes to clean embodiments of sluices described herein into a gold pan or other type of reservoir. Thus, a gold pan might contain only a small amount of super-concentrates. A quantity of gold present in a pan is easily estimated.

Some embodiments described herein employ a one-piece design that can be constructed from metals, plastics, rubber, or combinations thereof. Thus, embodiments of sluices and riffles described herein can be produced at a low cost.

Embodiments described herein can benefit prospectors at all levels, as sluices described herein are easy and intuitive to use and are extremely efficient. Such sluices bring new levels of insight, efficiency, and confidence to prospectors. It is also enjoyable to witness the new high order riffles passing black sands and accumulating gold under the clear view lens. Embodiments described herein have the speed and versatility of a sluice, the accuracy of a gold pan, and can be configured to perform the duties of a super-concentrator. The invention works even in a rugged river environment. These attributes of will be of great benefit to prospectors immediately upon the use of my new sluice.

Selected Definitions:

1. Clear View Lens: A clear view lens is a key water feature produced by embodiments described herein. It includes a lens formed in the top layer of the water flow. It can be positioned above the high order type riffles. By establishing this water feature the proper function of a riffle can be established, in various embodiments. The accumulation of gold and the erosion of black sand can be seen through this lens.

2. Turbulence: Turbulence is of little value towards the effective separation of gold from mineral waste including black sand. This is because the turbulent environment is chaotic. Turbulence is made up of many eddies that are constantly overwhelming each other. This results in seemingly random fluctuations in pressure. Each individual eddy within turbulence is using kinetic energy from the water or slurry flow. Each eddy is also converting that kinetic energy into low pressure drag. This twice impedes the flow. The presence of turbulence can indicate a low order flow. The turbulent flow is heavily impeded. The wave energy present is diffused and weak. Turbulence can be carefully metered. Too much can wash away even the heaviest of minerals. Too little turbulence can cause too much black sand to be collected for proper function. The level of turbulence required to produce concentrates in a river sluice will overwhelm a sluice designed to reduce concentrates to super-concentrates. Focused turbulence described in association with various sluices and riffles described herein serves to break the surface tension of the water in particular locations. Such turbulence can cause floating gold to sink, often in the particular locations. The use of turbulence can reduce the need for the use of detergents or other pollutants that can weaken surface tension to prevent floating gold and thus sink it.

3. High Order Flow: A high order flow is a flow of water or slurry (or other liquid or combination of liquid and material) that is moving with little obstruction or turbulence. This type of flow can retain the high level of kinetic energy necessary to drive high order riffle function. This type of flow can encourage heavy minerals to travel into a depression, or even layer at the bottom of a flow. A high order flow can travel faster than a turbulent flow. This type of flow can easily carry gravel through a sluice. This type of flow can exit embodiments described herein with an amount of force that can prevent waste minerals from backing up into the exit end of a new sluice. A high order flow can assimilate the turbulence generated by riffles back into high order flow before reaching the next riffle. A high order flow might not be perfect and in some embodiments a low level of turbulence will be present. Such minor turbulence can travel in an even and stable manner. This can produce an even and stable surface pattern on the flow. In various embodiments, a pattern can indicate an even and stable environment at the bottom of flow.

4. Concentrates: Concentrates can refer to the product of sluices. These can consist of substantially ninety-five percent waste minerals that substantially comprise black sand. Concentrates can also consist of substantially five percent gold and other valuable minerals. It should be appreciated by one of ordinary skill in the art that concentrates can contain other materials in various embodiments.

5. Super-concentrates: Super-concentrates can be derived from concentrates by various methods. In some embodiments, concentrates can be screened and gravel can be sieved from a concentrate. Subsequently, concentrates can be hand panned or sluiced again with a super-concentrator to reduce an amount of black sand. Other approaches may be employed to reduce concentrates down to a super-concentrate level. Super-concentrates should be of sufficient concentration such that a level of gold present can be accurately estimated and readily recovered. Super-concentrates can be produced by embodiments of sluices described herein. Super-concentrates can continue to accumulate precious minerals during use, since the volume of the super-concentrates does not increase during use in various embodiments. In various embodiments, a percentage of precious minerals in a super-concentrates can continue to rise during use.

6. High order riffle: A high order riffle can employ a high order flow which accelerates in a curve against a riffle to achieve greater velocity. The riffle form can shear the accelerated flow into two layers. The top layer can have sufficient velocity to pass slurry over the riffle. The lower layer (containing most heavy minerals) can be of sufficient velocity and order to create a vortex directly below the accelerated curve. The accelerated curve must have sufficient velocity to provide a rigid confine for any vortexes below it. The vortexes thus confined will be stationary and tend to have rotational qualities. These vortexes cannot travel and evolve to any lesser order. With a high order flow and high order vortexes thus established, the water particles tend to stay in alignment throughout the separation process. Thus aligned, the particles can exert less outward force resulting in less loss of velocity through friction. The high order flow and vortexes can present less interference to gravity, centrifugal and centripetal forces. The accelerated curve can exert centrifugal force downward onto the vortex. The centrifugal force exerted upward from the vortex can be opposed by a combination of gravity and the centrifugal force downward from the accelerated curve. The latter two forces combined can act as a centripetal force at the top of the high order vortex. This can make it easier for objects under the centrifugal force of the vortex to exit the sides and bottom of the vortex where there are no opposing forces rather than be thrown up into the flow and swept away. Note that the vortex can be on the upstream side of the shear created by the riffle. This can ensure that shear stress, resulting turbulent chaos, and eventual friction loss all occur definitively downstream of the high order function. The high order riffle appears to boil off black sand. The only example of a high order riffle currently is the new kreeger riffle.

7. Terminal velocity: In gravity separation terminal velocity can be the maximum particle settling velocity. The terminal velocity in a slurry flow over carpet is quite low because of its turbulence. Prior art with carpets and mats use a low velocity flow. Terminal velocity cannot increase without an increase in the order of flow. So that a higher velocity flow is useful for separation as long as it is of a higher order. The present disclosure achieves a higher terminal velocity than prior art because of its high order flow and high order riffle function.

SELECTED REFERENCE NUMERALS IN FIGURES

1 high order flow
2 clear view lens
3 high order vortex
4 turbulence in flow
5 turbulence reduction zone
6 descending wall of catch
7 shear wall of catch
8 notch seat
9 shear wall of notch
10 gentle down ramp
11 bottom of flow
12 entry bottom panel
13 bottom panel between riffles
14 exit bottom panel
15 vertical side wall
16 vertical side wall
17 clean up rail and handle
18 high order riffle Structure:

The following description of the embodiment(s) is merely exemplary (illustrative) in nature and is in no way intended to limit the invention, its application, or uses. Additionally, the invention may be practiced according to the claims without some or all of the illustrative information. Various embodiments employ a one piece design which is simple to construct from metals, plastics, rubber, ceramics, a combinations thereof, etc., and can be produced at low cost. As annotated in FIGS. 1 and 2, one example of the apparatus is substantially thirty-six inches in length and between five and ten inches wide. Of course, this is just an example. The size of a sluice can be based on a number of factors, such as the size and/or amount of material to be collected. A sluice could be scaled to 200% of the example given above, 300%, etc. The same scaling approach can be applied to various portions of riffles and sluices described herein as well, in accordance with various embodiments. Moreover, herein various embodiments indicate that pieces of embodiments may be joined and/or connected. It should be understood by one skilled in the art that pieces described herein can be made separately and attached together, or may be manufactured as one piece. Thus, when the terms connected, joined, meet, attached, machined, etc. are used, they can refer to either two or more pieces that are separate and somehow attached together, or a single piece that was manufactured such that one wall connects to another (but the combined structure is still a single piece).

FIG. 1 illustrates an example sluice 100, in accordance with various embodiments. Example sluice 100 comprises an entry bottom panel 12, bottom panels between riffles 13, and an exit bottom panel 14 (collectively referred to as bottom panels 12, 13, and 14). Example sluice 100 also comprises vertical side wall 15 and vertical side wall 16 (collectively referred to as vertical side walls 15 and 16, or vertical walls 15 and 16). Example sluice 100 also comprises a clean-up rail and handle 17. Further, example sluice 100 comprises high order riffles 18.

In various embodiments, bottom panels 12, 13, and 14 can be flat and extend the entire distance between the vertical walls 15 and 16. Together they can form a common plane referred to as the bottom of flow (e.g., 11 of FIG. 2). The bottom panels 12, 13, and 14 and the vertical walls 15 and 16 can be securely joined to form a water tight inside corner of substantially ninety degrees (e.g., such that water or other fluids cannot escape from the sluice). In various embodiments, vertical walls 15 and 16 can be parallel to each other, can be placed between substantially five and ten inches apart, and can extend the entire length of a sluice 100. Vertical walls 15 and 16 can rise between substantially three and five inches above a bottom panel 12, 13, and 14.

In some embodiments, one or more vertical walls 15 and 16 are attached/connected to a "clean-up" rail and handle 17. A clean-up rail and handle 17 can be attached to a wall 15 and 16 at a wall's highest point (e.g., the top of a wall 15 and 16). The clean-up rail and handle 17 can extend between one end of a sluice and substantially one and two inches within the opposite side of a sluice, as shown in example sluice 100. The clean-up rail and handle 17 can be joined securely (or attached/created/molded together/machined, etc.) to the vertical wall 15 and 16 forming a water tight inside corner of substantially ninety degrees. In some embodiments, the clean-up rail and handle 17 can extend from the exit end of the vertical wall 15 and 16 to the entry and be a length of approximately twenty-six and thirty inches. The entry bottom panel 12 can be substantially twelve inches in length parallel to a flow and begin at the same location as the vertical walls 15 and 16.

Figure 2:
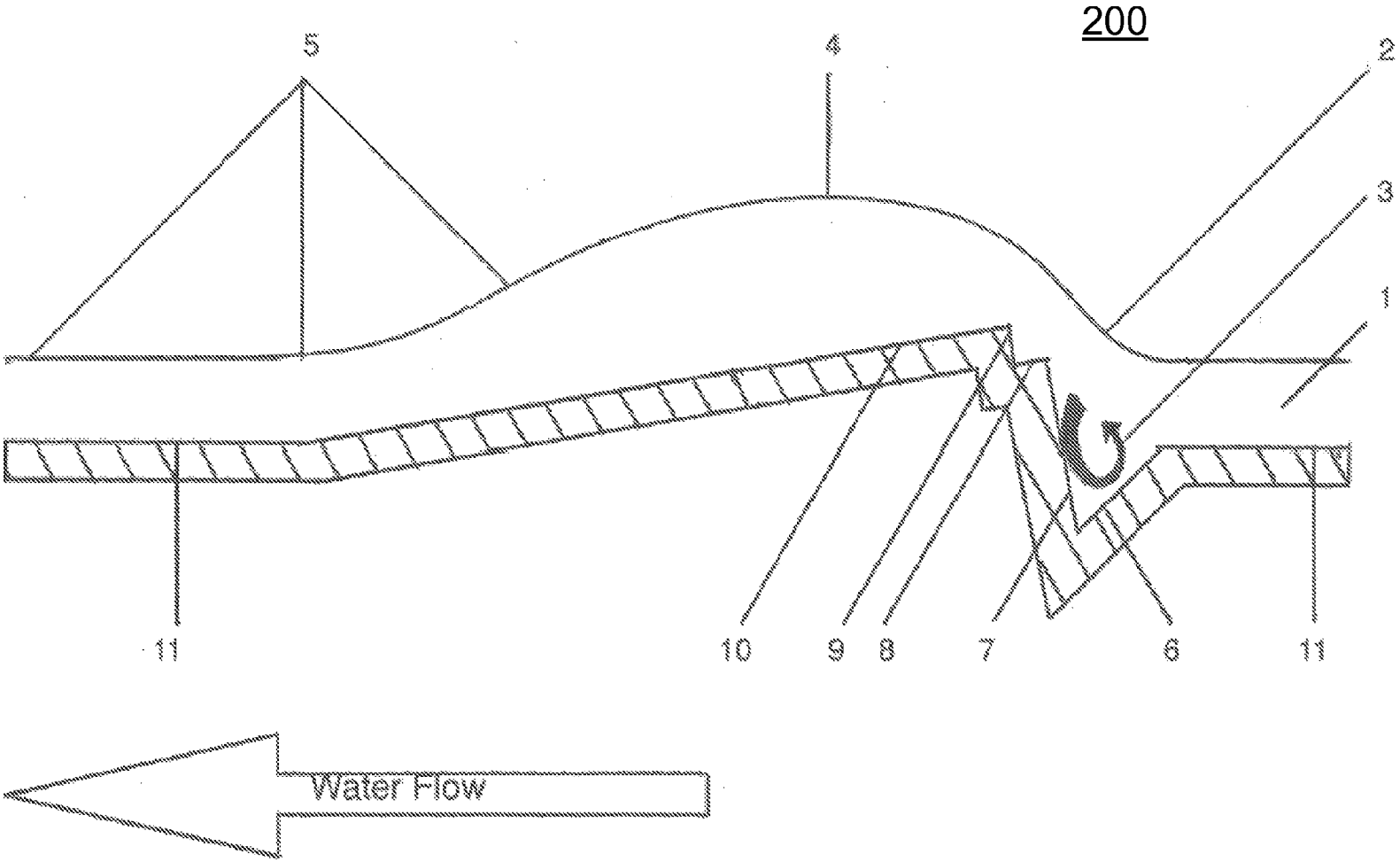
FIG. 2 illustrates a cross-section view of a high order riffle, in accordance with various embodiments described herein.

FIG. 2 illustrates a cross-section view of a high order riffle 200, in accordance with various embodiments described herein. In some embodiments, the plane at the bottom of a flow is broken only by the riffle components (e.g., elements 6-10). Riffle components 6-10 can extend between the vertical walls 15 and 16. The riffle components 6-10 and the vertical walls 15 and 16 can be securely joined to form a water tight inside corner of substantially ninety degrees.

In some embodiments, the high order riffle shown in FIG. 2 can be referred to as a compression type high order riffle. A high order riffle 200 can comprise a descending wall of the catch 6 which descends at approximately forty-five degrees in relation to the bottom of flow 11. The descending wall of catch 6 can be substantially between three-eighths and five-eighths of an inch in length. In some embodiments, the descending wall of catch 6 intersects the shear wall of catch 7 between one and three quarters of an inch below the bottom of flow 11. The shear wall of catch 7 can rise near vertically (e.g., at about a 90 degree angle in relation to a bottom panel 12, 13 or 14 of a sluice) substantially between three-eighths and five-eighths of an inch to its intersection with the notch seat 8. The shear wall of catch 7 and the descending wall of catch 6 can together constitute a catch. This catch can be where a high order vortex 3 performs mineral separation.

Unlike other riffles, high order riffle 18 can extend below a bottom of flow 11 and/or bottom panel 12, 13 and/or 14 and above a bottom of flow 11 and/or bottom panel 12, 13 and/or 14. For example, a descending wall of the catch 6 can extend below a bottom of flow 11 (and/or bottom panel 12, 13, and/or 14), and the shear wall catch 7 can extend above bottom of flow 11 (and/or bottom panel 12, 13, and/or 14) in the vertical direction. It should be understood by one skilled in the art that the exact angles of the descending wall 6 and ascending/shear wall of the catch 7 in relation to each other, a bottom of flow 11, and/or a bottom panel 12, 13, and/or 14, can vary. For example, in some embodiments a shear wall of a catch 7 can ascend at an angle substantially perpendicular to a bottom panel between riffles 13. Similarly, a descending wall of a catch 6 can descend at a substantially 45 degree angle relative to a bottom panel between riffles 13. However, this need not always be the case. In some embodiments, a descending wall of a catch 6 can descend at an angle that is more or less than 45 degrees relative to a bottom panel between riffles 13. Similarly, an ascending wall 7 can extend at an angle that is more or less than 90 degrees relative to a bottom panel between riffles 13. One of ordinary skill in the art can appreciate which angles for a particular wall work the best (e.g., be able to gather the correct materials most efficiently). In some embodiments, it is contemplated that the components of a riffle 6-10 can be modified, manipulated, or otherwise positioned based on properties associated with a riffle and/or sluice such as the amount of material (e.g., concentrate or super-concentrate) configured to build up in a placer, water speed, type of material used (e.g., gold, silver, black sand, a combination of materials), etc. Similarly, it is contemplated that one or ordinary skill in the art can adjust the angle of a sluice and/or water speed such based on an amount and/or type of concentrate or super-concentrate collected (e.g., the maximum amount possible). Still, in some embodiments, an angle of one or more particular components of a riffle 6-10 or an entire sluice 100 can be configured based at least in part on the composition of a flow (e.g., what type of materials and how much of them a flow includes/consists of), and/or based upon a capture rate (e.g., an amount of material collected in relation to a period of time).

In various embodiments, clear view lens 2 can be directly above the catch 6 and 7. The shear wall of catch 7 can intersect the notch seat 8 at its highest point. In some embodiments, the notch seat 8 is positioned at substantially ninety degrees in relation to the shear wall of catch 7. The shear wall of notch 9 can rise near vertical to its intersection with the gentle down ramp 10. In some embodiments, the notch seat 8 and the shear wall of notch wall 9 together constitute a notch of substantially one-eighth of an inch in both dimensions. A gentle down ramp 10 can begin at its intersection with the shear wall of notch 9. The intersection of the shear notch wall 9 and the gentle down ramp 10 is between one and three quarters of an inch above the bottom of flow 11. The shear notch wall 9 can be substantially ninety degrees in relation to the gentle down ramp 10. The gentle down ramp 10 can be substantially between one and three inches in length and ends at the bottom of flow 11. In some embodiments, a bottom panel between riffles 13 separates each riffle from the next. The exit bottom panel 14 begins at its intersection with the gentle down ramp 10 of the fifth high order riffle 18.

Operation:

To operate, in various embodiments, an outer most edge of the exit bottom panel 14 can be substantially three inches lower in elevation then the outer most edge of the entry bottom panel 12. Substantially one half of an inch of water is allowed to flow through a sluice 100. The water flow can be contained between the vertical side walls 15 and 16. This water flow can be the result of placing the sluice 100 directly into a river or stream. The water flow can also be provided by a water pump or a slurry flow from another device such as a wash plant. With water flow established, an operator can tune the sluice 100 for efficient operation. This can be accomplished in the traditional manner which is to adjust the quantity of water flow and the slope of the sluice. Upon reaching a sufficient balance of flow and slope required, embodiments described herein can indicate such by the appearance of the clear view lens 2. The clear view lens 2 can be a distinct water feature that appears above each high order riffle 18. The clear view lens can assure an operator of high order flow and function. With high order function thus established, the operator can be ready to add chosen sand and gravel to the water flow. The sand and gravel can pass through a screen with substantially one half inch openings or smaller (e.g., substantially ⅛ of an inch) before adding it to the water flow. This material can be added to the water flow at the entry bottom panel 12 to create a slurry. The descending wall of catch 6 and the shear wall of catch 7 together form a catch. Thus, the operator can see any black sand present cycle through the catch 6 and 7. This action can be seen through the clear view lens 2. This can show band of back sand substantially one half of an inch wide when the riffle 18 is at full capacity. The black sand can erode back into the water flow within seconds, leaving only gold and tiny gravels present in the catch 6 and 7. The rate of erosion observed can dictate the rate of which to add sand and gravel to the water flow (e.g., the rate at which material is added to a liquid can be based on a collection rate, a rate of erosion, etc.). The accumulation of gold can be seen through the clear view lens 2.

In some embodiments, the turbulence in flow 4 can break the surface tension of the water flow and cause floating gold to sink. The turbulence in flow 4 can be visibly returned to high order flow in the turbulence reduction zone 5. The bottom panel between riffles 13 is at the bottom of flow 11. The bottom panel between riffles 13 separates the riffles 18 from each other. The slurry flows over the exit bottom panel 14 as a high order flow. This exiting slurry has sufficient erosive force to help prevent backing up of expended mineral materials into the exit end of the new sluice.

In various embodiments, the clean up process begins with removing the sluice 100 from the river or removing any other water source from the sluice 100. Subsequently, an operator can place the exit bottom panel 14 into a gold pan or other suitable receptacle such as a bucket. The entry bottom panel 12 can remain slightly higher in elevation than the exit bottom panel 14 for the duration of the clean up. The sluice 100 is now rotated in an axis parallel to flow, toward the clean up rail and handle 17, to an angle of substantially forty-five degrees. In this position a riffle 200 can be easily rinsed toward the clean up rail and handle 17. The super-concentrates collected by the riffles will gather at the base of the vertical side wall 16. Subsequently, an operator can continue the rotation until reaching approximately ninety degrees from an operating position. In this position the vertical side wall 16 can act as a bottom plane and the clean up rail and handle 17 can act as a short vertical wall to contain the precious slurry. The super-concentrates can now be rinsed out of the invention in a fast and secure way. The clean up can produce just a few teaspoons or less of super-concentrates every time the invention is cleaned. This volume of super-concentrates is easily viewed in a gold pan immediately after the clean up. The clean up of the invention can take less than a few minutes (e.g., 1, 2, 3, 4, 5, etc.). The clean up rail and handle 17 is also used as a novel carrying handle.

Figure 3:
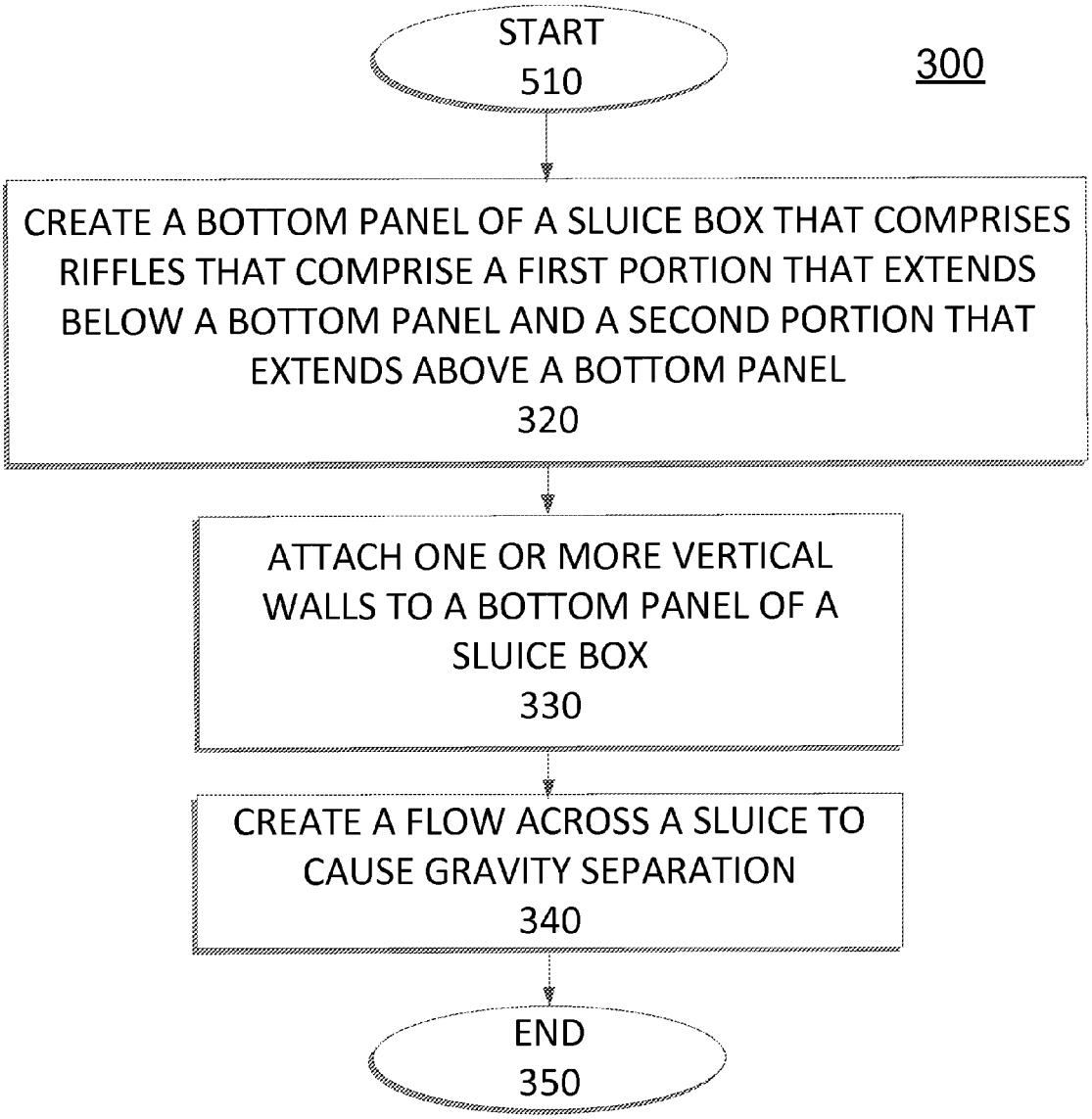
FIG. 3 illustrates an example flow diagram, in accordance with various embodiments described herein.

FIG. 3 illustrates an example flow diagram 300, in accordance with various embodiments described herein. Methods, systems, and other approaches may be performed according to the flow diagram 300. For example, flow diagram 300 can be used as support for a method of manufacturing a sluice (interchangeably referred to as a sluice box, herein). It should be appreciated that additional steps can be added, steps can be removed, and/or steps can be modified as appropriate. For example, step 340 could be removed in some embodiments. In addition, in some embodiments steps can occur in an order other than that shown in flow diagram 300.

Flow diagram 300 starts at step 310 and at step 320, a bottom panel of a sluice box can be created that comprises riffles that comprise a first portion that extends below a bottom panel and a second portion that extends above a bottom panel. At step 330 of flow diagram 300, one or more vertical walls can be attached to a bottom panel of a sluice box. In some embodiments, a top panel can be attached to a sluice box as well.

At step 340 of flow diagram 300, a flow can be created that flows across a sluice to cause gravity separation. This gravity separation can be used to a first material and/or mineral from at least a second material and/or mineral. For example, gravity separation can be used to separate gold from black sands, gravel, etc. In various embodiments, a classification can be provided which indicates what size of materials embodiments can be configured to use. For example, in some embodiments a sluice can have a ½ inch classification (e.g., the sluice can operate correctly when the flow comprises material that is a ½ inch or less). In other embodiments, a sluice can have a ⅛ inch classification. Flow diagram 300 then ends at step 350.

While specific embodiments of the invention have been described, it is understood that the present invention is not intended to be limited only to such embodiments. For example, there can be sizes/scales, variations, equivalents, and combinations of the device, so one should not take the above description as the only way or form it can be created. That is, this description is but one representation of what can be done to produce the device to perform in the intended manner. Additionally, the scope of the preferred embodiment should be defined by the following claims and their equivalents.

What is claimed is:

1. An apparatus comprising:
- a sluice box having a bottom panel; and
- a plurality of riffles located at the bottom panel, wherein a riffle comprises:
  - a descending wall having a first end and a second end, wherein the first end of the descending wall joins the bottom panel, and wherein the second end of the descending wall extends downward below the bottom panel at a predetermined angle; and
  - a shear wall having a first end and a second end, wherein the first end of the shear wall joins the second end of the descending wall, and wherein the second end of the shear wall extends upward until above the bottom panel.

2. The apparatus of claim 1, wherein the shear wall comprises a notch located at the second end of the shear wall, the notch including:
- a notch seat that is substantially orthogonal to the shear wall; and
- a notch shear wall that is substantially parallel to the shear wall.

3. The apparatus of claim 1, wherein the riffle further comprises a gentle down ramp having a first end and a second end, wherein the first end of the gentle down ramp joins the second end of the shear wall, and wherein the second end of the gentle down ramp extends downward from the second end of the shear wall toward the bottom panel in a direction of a flow of slurry.

4. The apparatus of claim 3, wherein the shear wall comprises a notch located at the second end of the shear wall, the notch including:
- a notch seat that is substantially orthogonal to the shear wall; and
- a notch shear wall that is substantially parallel to the shear wall.

5. The apparatus of claim 3, wherein the gentle down ramp is configured to create a high order flow.

6. The apparatus of claim 3, wherein the gentle down ramp and the shear wall form an angle substantially ninety degrees.

7. The apparatus of claim 4, wherein the predetermined angle is substantially one hundred and thirty five degrees, measured from the bottom panel, wherein the shear wall extends upward at an angle substantially orthogonal to the bottom panel, and wherein the gentle down ramp extends downward at an angle substantially ninety degrees from the shear wall.

8. The apparatus of claim 7, wherein:
- the notch seat is substantially parallel to the bottom panel; and
- the notch shear wall is substantially parallel to the shear wall.

9. The apparatus of claim 4, wherein the notch seat is substantially parallel to the bottom panel.

10. The apparatus of claim 4, wherein the notch shear wall is substantially parallel to the shear wall.

11. The apparatus of claim 4, wherein:
- the notch seat is substantially parallel to the bottom panel; and
- the notch shear wall is substantially parallel to the shear wall.

12. The apparatus of claim 4, wherein:
- the descending wall is substantially between three-eighths and five-eighths of an inch in length,
- the gentle down ramp is substantially one to three inches in length;
- the notch seat is substantially one-eighth of an inch in length; and
- the notch shear wall is substantially one-eighth of an inch in height.

13. The apparatus of claim 1, wherein a configuration of the descending wall and the shear wall creates a vortex for separating materials of different density in a slurry.

14. The apparatus of claim 13, wherein the vortex comprises a rotational vortex.

15. The apparatus of claim 1, wherein the sluice box is configured to operate at an incline angle of approximately five degrees from a horizontal axis.

16. The apparatus of claim 1, wherein the predetermined angle is substantially one hundred and thirty five degrees, measured from the bottom panel.

17. The apparatus of claim 1, wherein the shear wall extends upward at an angle substantially orthogonal to the bottom panel.

18. The apparatus of claim 1, wherein the sluice box further comprises a plurality of sidewalls, at least one sidewall configured to include a cleanup rail that also functions as a handle.

19. The apparatus of claim 18, wherein:
- a height of the side walls are substantially three to five inches; and
- a length of the cleanup rail is substantially between twenty-six and thirty inches.

20. The apparatus of claim 1, wherein:

a width of the sluice box is substantially between five to ten inches; and a length of the sluice box is substantially thirty-six inches.

* * * * *